US005776252A

United States Patent [19]

Koskinen

[11] Patent Number: 5,776,252

[45] Date of Patent: Jul. 7, 1998

[54] ASSEMBLY FOR PREVENTING STRIPING IN A SHORT DWELL TIME APPLICATOR

[75] Inventor: Jukka Koskinen, Järvenpää, Finland

[73] Assignee: Valmet Corporation, Helsinki, Finland

[21] Appl. No.: 714,758

[22] Filed: Sep. 16, 1996

[30] Foreign Application Priority Data

Sep. 20, 1995 [FI] Finland ..... 954450

[51] Int. Cl.[6] ..... B05C 3/02

[52] U.S. Cl. ..... 118/413; 118/410

[58] Field of Search ..... 118/419, 413, 118/410

[56] References Cited

U.S. PATENT DOCUMENTS

| | | | |
|---|---|---|---|
| 4,834,018 | 5/1989 | Sollinger et al. | 118/410 |
| 4,873,939 | 10/1989 | Eskelinen | 118/410 |
| 4,903,632 | 2/1990 | Sollinger | 119/410 |
| 5,108,787 | 4/1992 | Hiraki et al. | 427/128 |
| 5,119,757 | 6/1992 | Chino et al. | 118/410 |
| 5,173,120 | 12/1992 | Suzumura et al. | 118/410 |
| 5,192,591 | 3/1993 | Chance | 118/410 |
| 5,228,920 | 7/1993 | Thompson, III | 118/670 |
| 5,366,551 | 11/1994 | Aidun | 118/411 |

FOREIGN PATENT DOCUMENTS

| | | |
|---|---|---|
| 87096 | 8/1992 | Finland . |
| 88422 | 1/1993 | Finland . |
| 924206 | 3/1993 | Finland . |
| 90575 | 7/1993 | Finland . |
| 931064 | 9/1993 | Finland . |
| 942225 | 5/1994 | Finland . |
| 8084953 | 4/1996 | Japan . |

*Primary Examiner*—Brenda A. Lamb

*Attorney, Agent, or Firm*—Cohen, Pontani, Lieberman, Pavane

[57] ABSTRACT

An assembly, for preventing striping in an applicator used for coating a paper or paperboard web, comprising a doctor blade suitable for metering and smoothing a coat to be applied, a cross-machine elongated application chamber adapted immediately in front of the doctor blade, one of the sides of the chamber being formed by the web being coated. A flexible leading blade forming a front sealing edge of the chamber has a perforated stem with openings to allow coating mix from the application chamber to travel in front of the leading blade. A homogenizing chamber is formed in front of the openings in the leading blade using a dam lip or similar flow barrier. The flow exiting the openings of the leading blade is homogenized in the homogenizing chamber as the flow impinges against the flow barrier.

7 Claims, 1 Drawing Sheet

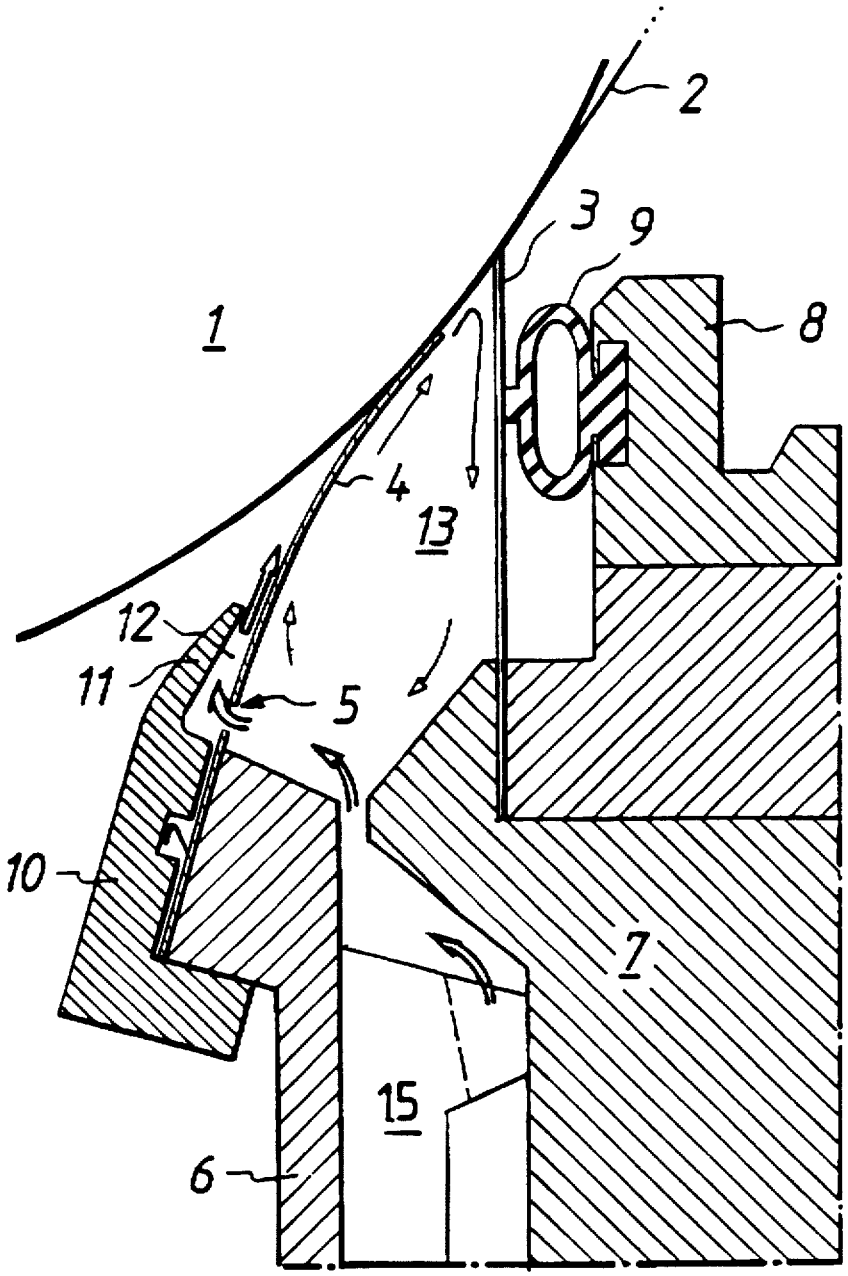
2
3
9
8
1
4
13
12
11
5
10
7
15
6

ASSEMBLY FOR PREVENTING STRIPING IN A SHORT DWELL TIME APPLICATOR

FIELD OF THE INVENTION

The present invention relates to an apparatus for preventing striping in an applicator adapted to use a flexible leading blade for coating a paper or paperboard web.

BACKGROUND OF THE INVENTION

Short dwell time applicators comprise an application chamber which is sealed in various manners against the web being coated. Conventionally, the rear edge of the chamber is formed by a large-angle doctor blade while the front edge of the chamber is provided with an adjustable front side. The ends of the application chamber are sealed by end dams which determine the width of the web area being coated. The web being coated travels against a backing roll and thus seals one edge of the application chamber. The space between the front side and the doctor blade forms an application zone in which the coating mix being fed into the application chamber is applied to the moving web. A nip is provided between the front side and the web, whereby the coating mix can flow via this nip counter-currently to the travel direction of the web. The purpose of the overflow is to prevent air from being entrained along with the moving web into the application chamber and to assure a sufficiently fast recirculation of the coating mix in the application chamber. The feed rate of coating mix is adjusted mainly to prevent air from entering the application chamber along with the web and simultaneously to assure cleaning of the chamber by a sufficiently high rate of coating mix recirculation. With an increase in the speed of the web being coated, the rate of coating mix overflow required for countering air entry must be increased correspondingly. The rate of overflow is controlled by adjusting the distance between the front side and the web.

Instead of a stiff front side, the front side of the application chamber can be sealed with a flexible blade. Such a blade is often referred to as a leading blade and it is mounted at a small angle relative to the web, in which case the leading blade is referred to as a small-angle doctor blade. The function of the leading blade is to accurately define the length of the application zone and to keep the internal pressure of the application chamber sufficiently high. Such an applicator apparatus is used for applying the coating mix onto a transfer roll or directly onto the web. By using the leading blade, the length of the application zone can be controlled more accurately than with a stiff side. The leading blade also prevents air from becoming entrained into the application chamber and simultaneously serves to shorten the length of the application chamber so that turbulence of the coating mix due to the friction between the web and the mix in the chamber is prevented, which turbulence can cause coating defects even at the highest web speeds. As the amount of coating mix fed into the chamber is chiefly determined in this type of applicator by the volumetric flow rate needed to maintain clean operating conditions in the application chamber, the pumping rate of the coating mix may herein be reduced substantially in comparison with a short dwell time coater.

Obviously, since flooding via the nip between the blade and the web is not possible in a leading blade coater, the flow in the direction opposite to the direction of movement of web must be arranged by other means. One such reverse-flooding method comprises providing openings to the stem of the leading blade, whereby coating mix can escape from the application chamber to the front side of the leading blade into the nip between the leading blade and the web. Also in this case, the reverse flow prevents air from entering the application chamber. Additionally, a pre-application layer of coat metered and smoothed by the leading blade is applied onto the web or transfer roll prior to the actual application stage. The reverse flow lubricates the blade riding on the moving web and thus prevents excessive wear and improves web runnability. The reverse flow is also required to keep the application chamber clean, because otherwise different kinds of impurities will easily accumulate in the application chamber such as paper chaff, fibers and coating mix aggregates that may cause defects on the coat by accumulating in the chamber and then plugging the nip between the doctor blade and the web. In the case that the reverse-flooding flow is arranged via openings in the leading blade, the pitch of the leading blade openings may become visible on the coat as striping.

For the purpose of reducing such striping, an arrangement has been developed in which the reverse flow is fed in front of the leading blade via the nip under the blade. In this embodiment the coating mix flow forming the reverse overflow will not be taken from the application chamber, but from a dedicated manifold, which reduces recirculation in the application chamber causing accumulation of coating mix solids and impurities in the application chamber. Due to the complex manifold employed, the applicator is difficult to clean and has a complex construction of the leading blade holder resulting in clumsy replacement of the leading blade. Also in the above-described embodiment, the function of the reverse flow is to assure sufficient overflow.

SUMMARY OF THE INVENTION

It is an object of the present invention to provide an arrangement capable of removing the slightest traces of striping that could be caused by the flow of coating mix via the leading blade openings.

In accordance with the present invention, a dam lip or similar coating mix flow barrier is placed behind the leading blade openings to form a chamber in which the coating mix flow exiting the openings in the leading blade is homogenized as the flow impinges against the flow barrier.

The present invention offers significant benefits. The principal benefit is that the striping conventionally associated with use of reverse flow of coating mix via openings in the leading blade can be eliminated by virtue of a simple construction without essentially altering the structure of an existing applicator. The coating mix is circulated via the application chamber, whereby a high rate of recirculation of coating mix and flushing of the application chamber are attained. Because significant modifications are not needed in the holder structure of the leading blade, easy replacement of the blade is still possible. As no additional manifold whatsoever is required, the cleaning of the applicator remains simple. The preferred embodiment according to the present invention is also relatively easy to implement with existing applicators.

Other objects and features of the present invention will become apparent from the following detailed description considered in conjunction with the accompanying drawing. It is to be understood, however, that the drawing is intended solely for purposes of illustration and not as a definition of the limits of the invention, for which reference should be made to the appended claims.

BRIEF DESCRIPTION OF THE DRAWINGS

The FIGURE is a cross-sectional side view of a preferred embodiment of the present invention.

DETAILED DESCRIPTION OF THE PRESENTLY PREFERRED EMBODIMENTS

Referring to the FIGURE, the applicator apparatus shown therein is of the leading blade type. This kind of apparatus is typically used for applying the coating mix onto a transfer roll, wherefrom the coat layer is further transferred onto the web being coated. The apparatus may also be employed for application onto a web 2, whereby the web 2 is arranged to run against a backing roll 1. The doctor blade 3 of the apparatus is mounted to a frame 7. In this type of applicator, the doctor blade 3 is loaded by a pneumatic tube 9, which is fixed to a beam 8 having movable segments. The segments of the beam 8 can be adjusted with respect to the doctor blade 3 by means of screws (not shown). Such a loading adjustment permits control of the blade profile and thus the profile of the coat applied to the web 1 or a transfer roll. Prior to or upstream of the doctor blade 3, the apparatus has a perforated leading blade 4, which is attached to a frame member 6. The leading blade 4 forms the front side of the application chamber 13, while the rear side is formed by the doctor blade 3. From below, the chamber 13 is formed by body members 7 and 6. From above, the chamber 13 is formed by the web 2 which travels on or is supported by the backing roll 1. On the top side of the chamber 13, an elongated slit is formed in the cross-machine direction between the edges of the blades 3, 4. The ends of the application chamber 13 are sealed with dams (not shown).

At the lower part of the application chamber, the lower edge of the leading blade 4 is provided with openings 5 through which coating mix can flow from the application chamber 13 to the front of the leading blade 4. The leading blade 4 is attached to the frame member 6 with a blade holder 10. At the end of the holder 10 facing the backing roll is a dam lip 11 extending over the openings 5 of the leading blade 4 so as to form a homogenizing chamber 12 in front of the openings 5.

The coating mix is fed into the application chamber 13 through a duct 15 formed in the frame members 6, 7. In the application chamber 13, a portion of the coating mix is applied to the web 2 through the slit formed between the edges of the leading blade 4 and the doctor blade 3, whereby the doctor blade 3 meters the coat applied to the web 2. An excess flow of the coating mix passes through openings 5 of the leading blade 4 thus providing a reverse flow which is taken back to the recirculation of the coating mix. When the reverse flow passes through the openings 5, it impinges against the dam lip 11 of the blade holder 10, whereby the jet-like stream of coating mix exiting the blade openings 5 is brought into a strong turbulence thus undergoing changes of flow direction. With the homogenizing chamber 12 filled with the coating mix, the excess mix flows out of the chamber 12 through the nip between the dam lip 11 and the leading blade 4 to the front side of the leading blade 4 as a homogeneous flow, free from any deviations from a uniform flow profile that could cause striping.

Alternatively, the smoothing dam lip 11 may be formed by a strip-like member attached in front of the openings 5 on the leading blade 4. Such a member may be formed by sheet steel or polymer strip. Furthermore, other types of flow barriers can be used, mounted in front of the openings 5 of the leading blade 4 so as to diffuse the jet flow of the coating mix exiting the openings 5 into a uniform flow pattern by way of at least partially allowing the jet flow of the coating mix to impinge on such a diffuser element. In this fashion, the present invention can be easily adapted or retrofitted to existing applicators.

Thus, while there have been shown and described and pointed out fundamental novel features of the invention as applied to a preferred embodiment thereof, it will be understood that various omissions and substitutions and changes in the form and details of the device illustrated, and in its operation, may be made by those skilled in the art without departing from the spirit of the invention. For example, it is expressly intended that all combinations of those elements which perform substantially the same function in substantially the same way to achieve the same results are within the scope of the invention. Substitutions of elements from one described embodiment to another are also fully intended and contemplated. It is also to be understood that the drawing is not necessarily drawn to scale but that it is merely conceptual in nature. It is the intention, therefore, to be limited only as indicated by the scope of the claims appended hereto.

What is claimed is:

1. An apparatus for preventing striping in an applicator for coating a paper or paperboard web comprising:

a frame;

a doctor blade mounted to the frame positioned so as to meter and smooth a coat onto a moving surface, the moving surface comprising one of the web and a roll for applying the coat to the web;

a flexible leading blade mounted to the frame so as to contact the moving surface, said leading blade having a stem perforated with a plurality of openings;

an elongated application chamber formed in the frame so that the doctor blade forms one side thereof, the leading blade forms a second side thereof, and the moving surface forms a third side thereof, the plurality of openings in said leading blade extending into said application chamber;

a means for supplying a coating mix into the application chamber; and a flow barrier disposed outside of said application chamber and positioned a distance from said leading blade, a homogenizing chamber formed by said flow barrier and said leading blade, the plurality of openings in said leading blade extending into said homogenizing chamber, an end of said flow barrier being proximate a surface of said leading blade so that flow of coating mix from said application chamber through the plurality of openings in said leading blade and out of said homogenizing chamber is constricted by said flow barrier and the surface of said leading blade.

2. The apparatus of claim 1, wherein said flow barrier comprises a dam lip having an upper edge proximate the surface of said leading blade so that an elongated slit is formed between said leading blade and said dam lip.

3. The apparatus of claim 2, further comprising a blade holder for mounting said leading blade to the frame, and wherein said dam lip is a projection formed in said blade holder.

4. The apparatus of claim 3, wherein said dam lip directs the flow of coating mix though the plurality of openings in said leading blade toward the moving surface.

5. The apparatus of claim 2, further comprising a strip attached to said leading blade and said dam lip is formed by said strip.

6. The apparatus of claim 2, wherein said dam lip directs the flow of coating mix though the plurality of openings in said leading blade toward the moving surface.

7. The apparatus of claim 1, wherein said flow barrier directs the flow of coating mix though the plurality of openings in said leading blade toward the moving surface.

* * * * *